US006027634A

United States Patent [19]

Shirodkar et al.

[11] Patent Number: 6,027,634

[45] Date of Patent: Feb. 22, 2000

[54] PROCESS FOR STABLE AQUEOUS ASPHALTENE SUSPENSIONS

[75] Inventors: Shailaja Madhusudhan Shirodkar, Wappingers Falls; Ronald James McKeon, Beacon, both of N.Y.

[73] Assignee: Texaco Inc., White Plains, N.Y.

[21] Appl. No.: 08/599,911

[22] Filed: Feb. 12, 1996

[51] Int. Cl.[7] ..... C10C 1/20

[52] U.S. Cl. ..... 208/39; 208/44; 208/347; 208/309; 252/311.5

[58] Field of Search ..... 208/397, 39, 44, 208/309; 252/311.5

[56] References Cited

U.S. PATENT DOCUMENTS

| | | | |
|---|---|---|---|
| 4,121,995 | 10/1978 | Hsu | 44/51 |
| 4,547,224 | 10/1985 | Schilling | 252/311.5 |
| 4,765,885 | 8/1988 | Sadehi et al. | 208/391 |
| 4,775,489 | 10/1988 | Watkins et al. | 252/8.552 |
| 4,891,131 | 1/1990 | Sadehi et al. | 208/391 |
| 5,017,281 | 5/1991 | Sadehi et al. | 208/391 |
| 5,336,438 | 8/1994 | Schilling | 252/311.5 |

*Primary Examiner*—Helane Myers
*Attorney, Agent, or Firm*—Henry H. Gibson; Morgan & Finnegan

[57] ABSTRACT

A petroleum derived oil is subjected to propane deasphalting to yield a solid asphaltene residue. The residue is crushed to 425 micron diameter particle or less at a crushing temperature in the range of 77° F. to 122° F. The asphaltene particles are suspended in a residual petroleum oil emulsion. The resulting suspension comprises 5 wt % to 40 wt % asphaltene particles. The 40 wt % asphaltene suspensions are boiler fuel. The 5 wt % asphaltene suspensions are gasified with a deficit of oxygen to produce synthesis gas. The suspensions are stable and transportable by pumping through a pipeline.

35 Claims, No Drawings

PROCESS FOR STABLE AQUEOUS ASPHALTENE SUSPENSIONS

BACKGROUND OF THE INVENTION

1. Field of the Invention

The invention is a process for producing stable asphaltene suspensions. The suspensions comprise asphaltene particles, an oil-water emulsion and an emulsifying agent.

2. Description of Related Methods in the Field

Crude petroleum is refined to produce fuel and lubricating products. Crude petroleum may be supplemented with lesser amounts of other crude oils from bituminous sand and shale. These crude petroleums require greater or lesser amounts of refining to convert them to products based on their properties. Their properties are determined by the sum of the component properties.

Crude petroleums with greater amounts of impurities including asphaltenes, metals, organic sulfur and organic nitrogen require more severe processing to remove them. Of these constituents, asphaltenes are removed relatively earlier in the refining process because they interfere with processes such as hydrotreating used to remove the other impurities. In particular, asphaltenes produce amounts of coke which deactivates hydrotreating catalyst. Asphaltenes also form precipitates and contain precipitate precursors which hinder subsequent processing.

U.S. Pat. No. 5,000,757 to S. J. Puttock et al. discloses the preparation and combustion of fuel oil emulsions.

U.S. Pat. No. 5,089,052 to A. C. Ludwig discloses the emulsification of rock asphalt. The emulsions are formulated to be effective as binders for limestone aggregate coatings, seals, coats, pliable mats and other applications.

U.S. Pat. No. 4,776,977 to S. E. Taylor discloses emulsions of oil in water. These emulsions are noted for the relatively high proportion of discontinuous phase. The emulsions are suitable for pipeline transportation.

U.K. Patent 1,340,022 to A. Goudsmit et al. discloses the preparation of aqueous suspensions of asphaltenes. The suspensions are prepared by mixing water and colloidal clay with a suspension of asphaltenes in an organic liquid. The organic liquid is then removed by evaporation.

There is a need in the art for a process which consumes and commercially uses solid asphaltenes from a solvent deasphalting process.

SUMMARY OF THE INVENTION

The invention is a process for forming stable aqueous asphaltene suspensions.

A petroleum derived oil is deasphalted by extraction with a deasphalting solvent to yield as the insoluble phase, a solid asphaltene residue. The solid asphaltene residue is subjected to size reduction to produce asphaltene particles having an average diameter of 1000 microns or less.

Water and petroleum oil are admixed with 0.5 wt % to 5 wt % of an emulsifying agent to form an emulsion. The asphaltene particles are admixed in the emulsion in an amount of 5 wt % to 40 wt % to produce a stable asphaltene suspension.

The suspensions are sufficiently stable that they are transportable by pumping through a pipeline from their source to point of use, The suspensions are used for their caloric content as boiler fuel to produce steam. In the alternative, the suspensions are used based on hydrocarbon and water content as gasification process feedstock to make syngas.

DETAILED DESCRIPTION OF THE INVENTION

The invention is a process for commercially utilizing a solid asphaltene residue. Asphaltene residue is defined analytically as the insoluble fraction which remains after 1 gram of a hydrocarbon oil, such as a petroleum derived oil, is extracted with 40 milliliters of heptane.

In the petroleum refining industry, a solid asphaltene residue is the byproduct of a solvent deasphalting process which removes asphaltenes from petroleum fractions. Petroleum fractions are subjected to solvent deasphalting early in the petroleum refining process because the presence of asphaltenes hinders most subsequent refining processes.

In solvent deasphalting, an oil is extracted by mixing with a deasphalting solvent. Deasphalting solvents which are useful for this purpose include $C_2$ to $C_8$ paraffins, furfural and N-methyl-2-pyrrolidone. Propane and butane are preferred.

Propane solvent results in the least yield of deasphalted oil. Propane is the preferred commercial solvent. For this reason, the process is often referred to as propane deasphalting.

Iso-butane and n-butane are also used commercially. Butane solvents yield less of asphaltene than propane solvent. Because the resulting asphaltenes do not have a well defined commercial use, the higher yield of deasphalted oil and lesser amounts of asphaltene byproduct is often commercially advantageous.

Propane or butane deasphalting produces an asphaltene which is solid at atmospheric temperatures. The softening point is 100° F. to 200° F., typically 180° F. to 200° F. as measured by the Ring and Ball (ASTM D-36 or E-28). The higher softening point asphaltenes are hard at atmospheric temperature, and therefore susceptible to grinding to produce the fine particles used in the invention.

Higher molecular weight deasphalting solvents produce asphaltenes displaying a higher softening point. Because the heat generated during grinding softens these asphaltene, cryogenic grinding may be required to reduce them to the particle size required in the invention.

Softer asphaltenes are typically used for road paving. In the alternative, they can be subjected to hydrocracking in an ebullated bed process. This disposition is less useful because of high sulfur, nitrogen and ash residue and because of insolubility with other hydrocarbon oils. Hard asphaltenes heretofore have been a disposal problem because they are not useful for road paving or for hydrocracking. They are best disposed of by use in the invention.

Asphaltenes are found predominantly in petroleum fractions with other hydrocarbons of similar molecular weight and boiling range. Generally, a crude petroleum is fractionated to remove liquid fuel and lighter fractions such as light gas oil, gasoline, diesel oil and kerosene collectively having a boiling range of 360° F. to about 650° F. Gas oil and vacuum gas oil fractions are removed by atmospheric and vacuum distillation. These fractions have a boiling range of about 600° F. to about 900° F. The petroleum vacuum residuum has an initial boiling point of approximately 900° F. and boils over a range exceeding 1100° F. Petroleum vacuum residuum is the primary source of asphaltenes.

The petroleum vacuum residuum is subjected to countercurrent contacting at solvent deasphalting conditions, generally at a temperature in the range of 50° F. to 400° F., preferably 150° F. to 300° F., a dosage of from 0.5 to 10, preferably 1.0 to 3.0 vol. solvent/vol. oil and a pressure of atmospheric pressure to 400 psig, preferably atmospheric pressure to 50 psig. The actual deasphalting conditions chosen are dependent on the solvent. That is, the temperature chosen should not exceed the critical temperature of the solvent and the pressure is maintained above the autogenous pressure to prevent vaporization.

A deasphalted oil and solvent are removed by distillation. Residual solvent and oil are stripped from the asphaltene layer leaving a solid asphaltene residue.

Solvent deasphalting within these parameters is practiced commercially as the ROSE® process (Residual Oil Solvent Extraction). The ROSE® process relies on cryogenic regeneration of solvent. This process is effective for producing the solid asphaltene residue of the invention.

The solid asphaltene residue is subjected to size reduction to reduce the average particle diameter to 1000 millimicron or less. The asphaltene residue has a softening point of about 160° F. to 300° F. It is therefore necessary to maintain the size reduction temperature well below the softening point to carry out the process effectively. Besides softening point, the temperature of the stable asphaltene suspension is a consideration. In the specified proportions, the thick suspensions are stable and pumpable. Any evaporative water loss would further thicken the suspension to an immobile or instable mass. Particle temperatures in excess of 167° F. would result in evaporative water loss. A size reduction temperature of 167° F. or less is recommended and a temperature in the range of 77° F. to 122° F. is preferred.

It is possible to achieve size reduction at this temperature by grinding with the aid of a chilling medium. When the chilling medium is provided at the temperature of liquid nitrogen, the process is referred to as cryogenic. Because cryogenic grinding is relatively expensive, in the alternative crushing is used. Crushing to the required particle size can be carried out by means of hammer mill, roller mill, jaw crusher and the like. It is well known in the art to carry out size reduction of the solid asphaltene residue to 1000 micron or less, typically 300 micron to 1000 micron, preferably 400 micron to 500 micron without exceeding an effective size reduction temperature.

Inventors discovered the invention in their study of low grade emulsions of 60 wt % to 80 wt % petroleum residue with surfactant in water. Specifically a commercially available emulsion is referred to in the petroleum refining industry as ORIMULSION®. This emulsion comprises heavy asphalt emulsified with the aide of surfactants in water for transportation through a pipeline.

The invention is also useful for enhancing the caloric content of other low grade water emulsions and disposing of an undesirable asphaltene solid. For example, the petroleum oil of the emulsion may come from sources such as crude petroleum fuel fractions boiling in the range of 90° F. to 800° F., vacuum distillate fractions boiling in the range of 800° F. to 1100° F., asphalt, asphaltene, maltene, coal tar, pitch, slurry oils and mixtures thereof.

The emulsion is formed by heating the petroleum residue in water to a temperature of 120° F. to about 220° F. with mixing such as stirring or motionless mixing. The amount of petroleum residue which can be incorporated into the emulsion is determined by routine laboratory procedures. This amount may be as low as 5 wt % and as high as 40 wt % or more.

The oil-in-water emulsion is formed with the aide of an emulsifying agent such as a cationic, anionic or nonionic surfactant. Emulsifying agents are alternatively referred to in the art as wetting agents, surface active agents, synthetic detergents and the like.

Cationic surfactants include quaternary ammonium salts, n-alkyl diamines, n-alkyl triamines, salts of fatty amines, amido amines and mixtures thereof.

Anionic surfactants include soap, and the sodium salts or organic sulfonates and sulfates. Examples include alkyl, aryl and alkylaryl sulfates and sulfonates. Also included are fatty alcohols. Examples include dodecylbenzene sulfonate, sodium lauryl sulfonate and lignin sulfonate.

Nonionic surfactants include ethoxylated alkyl phenols, ethoxylated secondary alcohols, ethoxylated amines, ethoxylated sorbitan esters and mixtures thereof.

The suspensions of the invention are prepared from oil-in-water emulsions of residual petroleum oil and asphaltenes. The suspensions comprise 5 wt % to 40 wt % of the asphaltene particles with the remainder comprising emulsion. The asphaltene particles are combined with the emulsion by admixing, typically by use of motionless mixer. The term suspending herein has the same meaning as mixing.

The asphaltene content produces suspensions with a weight proportion of asphaltene of 5 wt % to 40 wt %. Suspensions of about 5 wt % asphaltene are used as feedstock for a gasifier with less than stoichiometric oxygen to produce synthesis gas (syngas). Suspension of about 40 wt % asphaltene are used as boiler fuel to make steam.

This invention is shown by way of Example:

EXAMPLE 1

Asphaltene from propane deasphalting was ground in a Glen Mills rotating knife grinder to a 2 micron size and then sieved through a 40 U.S. Standard mesh sieve (425 microns). This ground asphaltene was then suspended in a 70:30 (wt:wt) asphalt:water emulsion prepared with ethoxylated nonyl phenols. As reported in Table 1, 15% by weight of propane deasphalted asphaltene was added without exceeding a suspension viscosity of about 1000 cP at 300 $sec^{-1}$ shear rate. The viscosity was measured by a Boulin viscometer.

TABLE 1

Effect of propane deasphalting derived asphaltenes on the viscosity of a suspension

| wt % Asphaltene | Viscosity (cP) |
|---|---|
| 4.8 | 450 |
| 9.7 | 600 |
| 14.5 | 800 |

EXAMPLE 2

Asphaltene from butane deasphalting was ground in a Glen Mills rotating knife grinder to a 2 micron size and then sieved through a 40 U.S. Standard mesh sieve (425 microns). This asphaltene was then suspended in a 70:30 (wt:wt) asphalt:water emulsion prepared with ethoxylated nonyl phenols. The data in Table 2 reports that up to 30% of butane deasphalted asphaltene was added without exceeding a suspension viscosity of about 1000 cP at 300 $sec^{-1}$ shear rate.

TABLE 2

| Effect of butane deasphalting derived asphaltenes on the viscosity of a suspension | |
|---|---|
| wt % asphaltene | Viscosity (cP) |
| 6.5 | 525 |
| 12.3 | 585 |
| 17.4 | 700 |
| 21.9 | 780 |
| 26.27 | 800 |
| 29 | 920 |
| 30.5 | 980 |

Table 3 reports data showing the increase in caloric value by adding asphaltene particles to the asphalt emulsion. The caloric value of the suspension is the same as or greater than that of the emulsion.

TABLE 3

| wt % Asphaltene | Experimental BTU/lb |
|---|---|
| None | 13,200 |
| 5 wt % $C_3$ asphaltene | 13,400 |
| 10 wt % $C_3$ asphaltene | 13,670 |
| 15 wt % $C_3$ asphaltene | 13,540 |
| 10 wt % $C_3$ asphaltene | 13,270 |
| 20 wt % $C_3$ asphaltene | 13,640 |

While particular embodiments of the invention have been described, it will be understood that the invention is not limited thereto since many modifications may be made, and it is, therefore, contemplated to cover by the appended claims any such modification as falls within the true spirit and scope of the invention.

The formation of petroleum residual oil emulsions is well known in the art. It is known for example that formation conditions are varied along with surfactant and optionally salts. High shear equipment is used such as motionless mixers and the like.

What is claimed is:

1. A process for forming a stable aqueous asphaltene suspension comprising:

a. deasphalting a petroleum derived oil with a deasphalting solvent to yield a solid asphaltene residue;

b. subjecting the solid asphaltene residue to size reduction to produce asphaltene particles having an average particle diameter of 1000 microns or less;

c. admixing 0.5 wt % to 5 wt % of an emulsifying agent, water, a petroleum oil and 5 wt % to 40 wt % of the asphaltene particles to produce a stable asphaltene suspension.

2. The process of claim 1 wherein the admixing is at an admixing temperature of 167° F. or less.

3. The process of claim 1 wherein the admixing is at an admixing temperature of 77° F. to 122° F.

4. The process of claim 1 wherein the average particle diameter is 300 micron to 1000 micron.

5. The process of claim 1 wherein the average particle diameter is 400 micron to 500 micron.

6. The process of claim 1 wherein the petroleum oil is selected from the group consisting of crude petroleum fuel fractions boiling in the range of 90° F. to 800° F., vacuum distillate fractions boiling in the range of 800° F. to 1100° F., asphalt, asphaltene, maltene, coal tar, pitch, slurry oil and mixtures thereof.

7. The process of claim 1 wherein the petroleum oil is selected from the group consisting of intermediate distillate fractions boiling in the range of 650° F. to 800° F., vacuum distillate fractions boiling in the range of 800° F. to 1100° F., asphalt, asphaltene, and mixtures thereof.

8. The process of claim 1 wherein the petroleum oil is asphalt.

9. The process of claim 1 wherein the stable asphaltene suspension comprises 10 wt % to 30 wt % asphaltene particles.

10. The process of claim 1 wherein the insoluble asphaltene fraction is solidified to a solid asphaltene residue having a softening point of 160° F. to 300° F.

11. The process of claim 1 wherein the deasphalting solvent is a $C_3$–$C_4$ paraffin.

12. The process of claim 1 wherein the deasphalting solvent is a $C_4$ paraffin.

13. The process of claim 1 wherein the emulsifying agent is selected from the group consisting of cationic, anionic and nonionic surfactants.

14. The process of claim 1 wherein the emulsifying agent is a cationic surfactant selected from the group consisting of quaternary ammonium salts, n-alkyl diamines, n-alkyl triamines, salts of fatty amines, amido amines and mixtures thereof.

15. The process of claim 1 wherein the emulsifying agent is an anionic surfactant selected from the group consisting of alkyl sulfonates, aryl sulfonates, alkylaryl sulfonates, alkyl phosphates, aryl phosphates, alkylaryl phosphates and mixtures thereof.

16. The process of claim 1 wherein the emulsifying agent is a nonionic surfactant selected from the group consisting of ethoxylated alkyl phenols, ethoxylated secondary alcohols, ethoxylated amines, ethoxylated sorbitan esters and mixtures thereof.

17. A process for forming a stable aqueous asphaltene suspension comprising:

a. deasphalting a petroleum derived oil with a $C_3$–$C_4$ paraffin to yield a solid asphaltene residue;

b. subjecting the solid asphaltene residue to a size reduction temperature of 167° F. or lower to produce asphaltene particles having an average particle diameter of 300 micron to 1000 micron;

c. admixing 0.5 to 5 wt % of an emulsifying agent selected from the group consisting of cationic, anionic and nonionic surfactants with water and a petroleum oil to form an emulsion and suspending therein 5 to 40 wt % of the asphaltene particles to produce a stable asphaltene suspension.

18. The process of claim 17 wherein the average particle diameter is 400 millimicron to 500 millimicron.

19. The process of claim 17 wherein the petroleum oil is selected from the group consisting of asphalt, asphaltene, maltene, intermediate distillate fractions boiling in the range of 650° F. to 800° F., vacuum distillate fractions boiling in the range of 800° F. to 1100° F. and mixtures thereof.

20. The process of claim 17 wherein the petroleum oil is selected from the group consisting of asphalt, asphaltene and mixtures thereof.

21. The process of claim 17 wherein the petroleum oil consists of asphalt and the stable asphaltene suspension comprises 10 wt % to 30 wt % asphaltene particles.

22. The process of claim 17 wherein extracting is carried out to produce a solid asphaltene residue having a softening point of 160° F. to 300° F.

23. The process of claim 17 wherein extracting is with a $C_3$ paraffin.

24. The process of claim 17 wherein extracting is with a $C_4$ paraffin.

25. The process of claim 17 wherein the admixing temperature is 77° F. to 122° F.

26. A stable aqueous asphaltene suspension obtained according to the process of claim 1.

27. A stable aqueous asphaltene suspension obtained according to the process of claim 6.

28. A stable aqueous asphaltene suspension obtained according to the process of claim 7.

29. A stable aqueous asphaltene suspension obtained according to the process of claim 11.

30. A stable aqueous asphaltene suspension obtained according to the process of claim 14.

31. A stable aqueous asphaltene suspension obtained according to the process of claim 15.

32. A stable aqueous asphaltene suspension obtained according to the process of claim 16.

33. A stable aqueous asphaltene suspension obtained according to the process of claim 17.

34. A stable aqueous asphaltene suspension obtained according to the process of claim 19.

35. A stable aqueous asphaltene suspension obtained according to the process of claim 20.

* * * * *